US008170260B2

(12) United States Patent
Reining et al.

(10) Patent No.: US 8,170,260 B2
(45) Date of Patent: May 1, 2012

(54) SYSTEM FOR DETERMINING THE POSITION OF SOUND SOURCES

(75) Inventors: Friedrich Reining, Vienna (AT); Richard Pribyl, Fischamend (AT)

(73) Assignee: AKG Acoustics GmbH, Vienna (AT)

( * ) Notice: Subject to any disclaimer, the term of this patent is extended or adjusted under 35 U.S.C. 154(b) by 1164 days.

(21) Appl. No.: 11/961,354

(22) Filed: Dec. 20, 2007

(65) Prior Publication Data

US 2008/0144876 A1 Jun. 19, 2008

Related U.S. Application Data

(63) Continuation-in-part of application No. PCT/EP2006/006012, filed on Jun. 22, 2006.

(30) Foreign Application Priority Data

Jun. 23, 2005 (EP) ..... 05450113

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |

(52) U.S. Cl. ..... 381/369; 381/92; 381/122

(58) Field of Classification Search ..... 381/369, 381/92, 122

See application file for complete search history.

(56) References Cited

U.S. PATENT DOCUMENTS

| | | | | |
|---|---|---|---|---|
| 4,042,779 | A | 8/1977 | Craven et al. | |
| 5,073,936 | A | 12/1991 | Görike et al. | |
| 6,522,761 | B1 | 2/2003 | Ruffa | |
| 6,727,935 | B1 | 4/2004 | Allen et al. | |
| 7,835,531 | B2 * | 11/2010 | Nell | 381/113 |
| 2003/0184645 | A1 | 10/2003 | Biegelsen et al. | |
| 2005/0111674 | A1 | 5/2005 | Hsu | |
| 2006/0222187 | A1 * | 10/2006 | Jarrett et al. | 381/92 |
| 2007/0009115 | A1 | 1/2007 | Reining et al. | |
| 2007/0009116 | A1 | 1/2007 | Reining et al. | |
| 2007/0071249 | A1 | 3/2007 | Reining et al. | |

FOREIGN PATENT DOCUMENTS

| | | |
|---|---|---|
| DE | 198 54 373 A1 | 11/1998 |
| GB | 344967 | 12/1929 |
| JP | 56-35596 | 4/1981 |
| JP | 11-331977 | 11/1999 |
| JP | 2000-75014 | 3/2000 |
| WO | WO 02/25632 A1 | 9/2001 |

* cited by examiner

*Primary Examiner* — Phat X Cao

(57) ABSTRACT

A system determines the position of a sound source with a microphone in a fixed coordinate system. The microphone measures audio signals that are analyzed and processed to determine the position of the sound source in the fixed coordinate system. The system may adjust the direction of the microphone in the fixed coordinate system based on the processed audio signals and the position of the sound source. The microphone direction may be identified through an optical source that may be adjusted based on the processed audio signals and the position of the sound source.

13 Claims, 7 Drawing Sheets

Figure 5
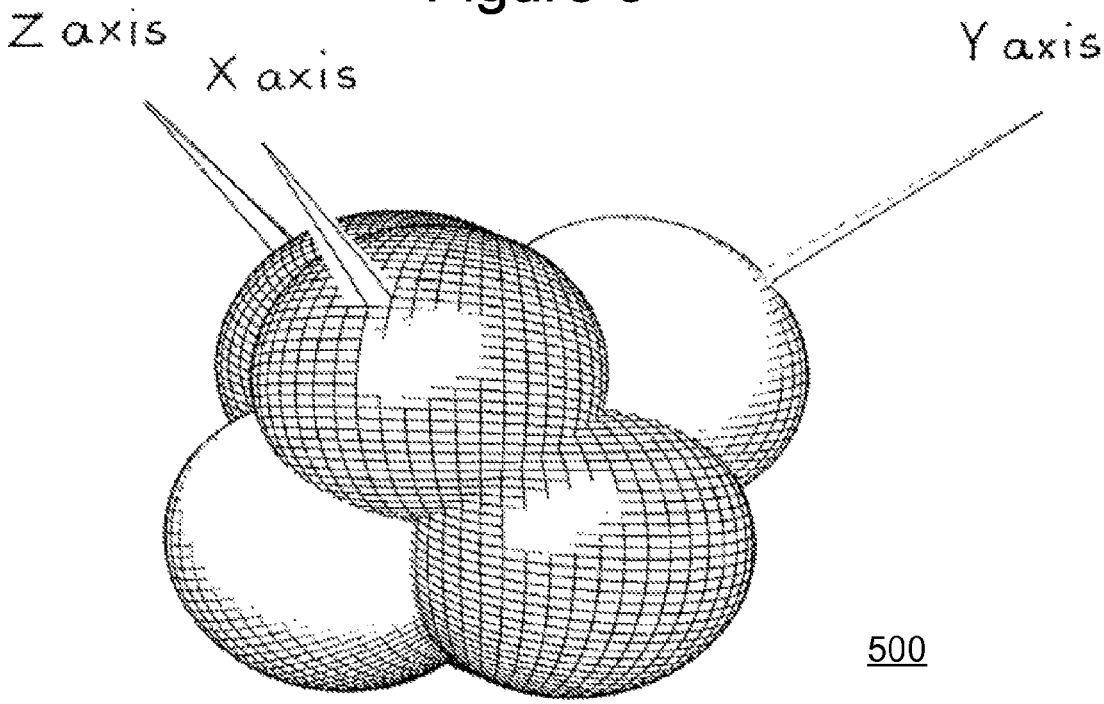
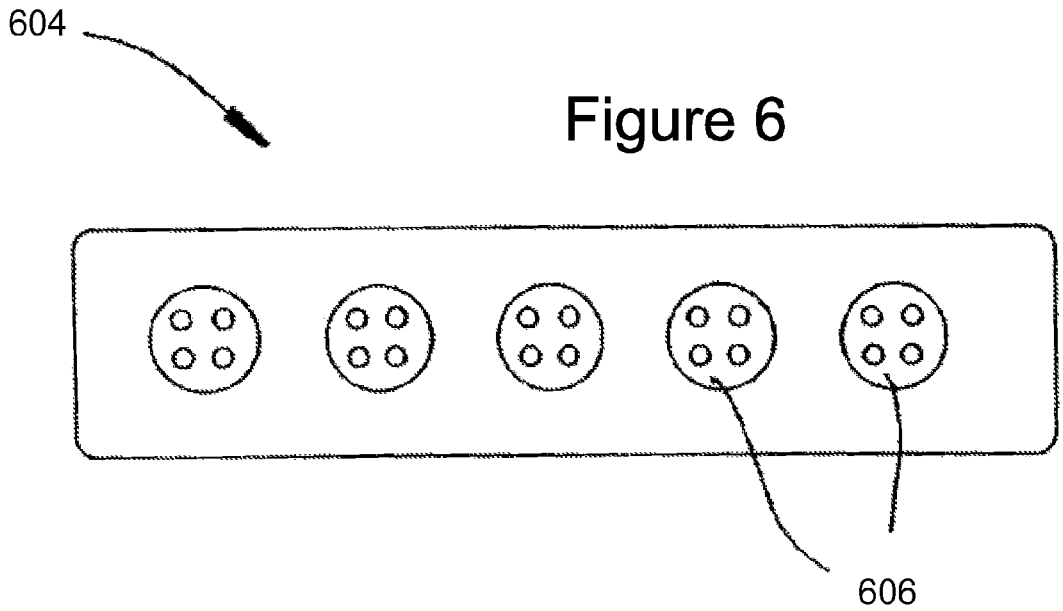
Figure 6

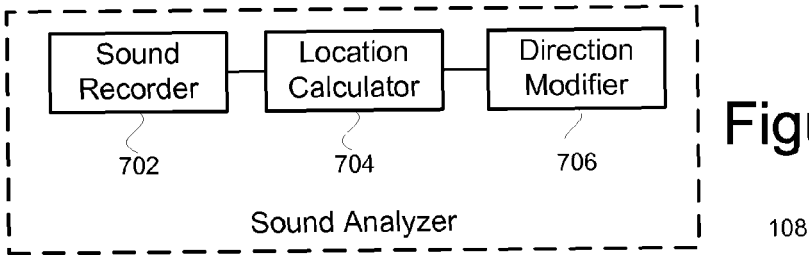
Figure 7
Figure 8
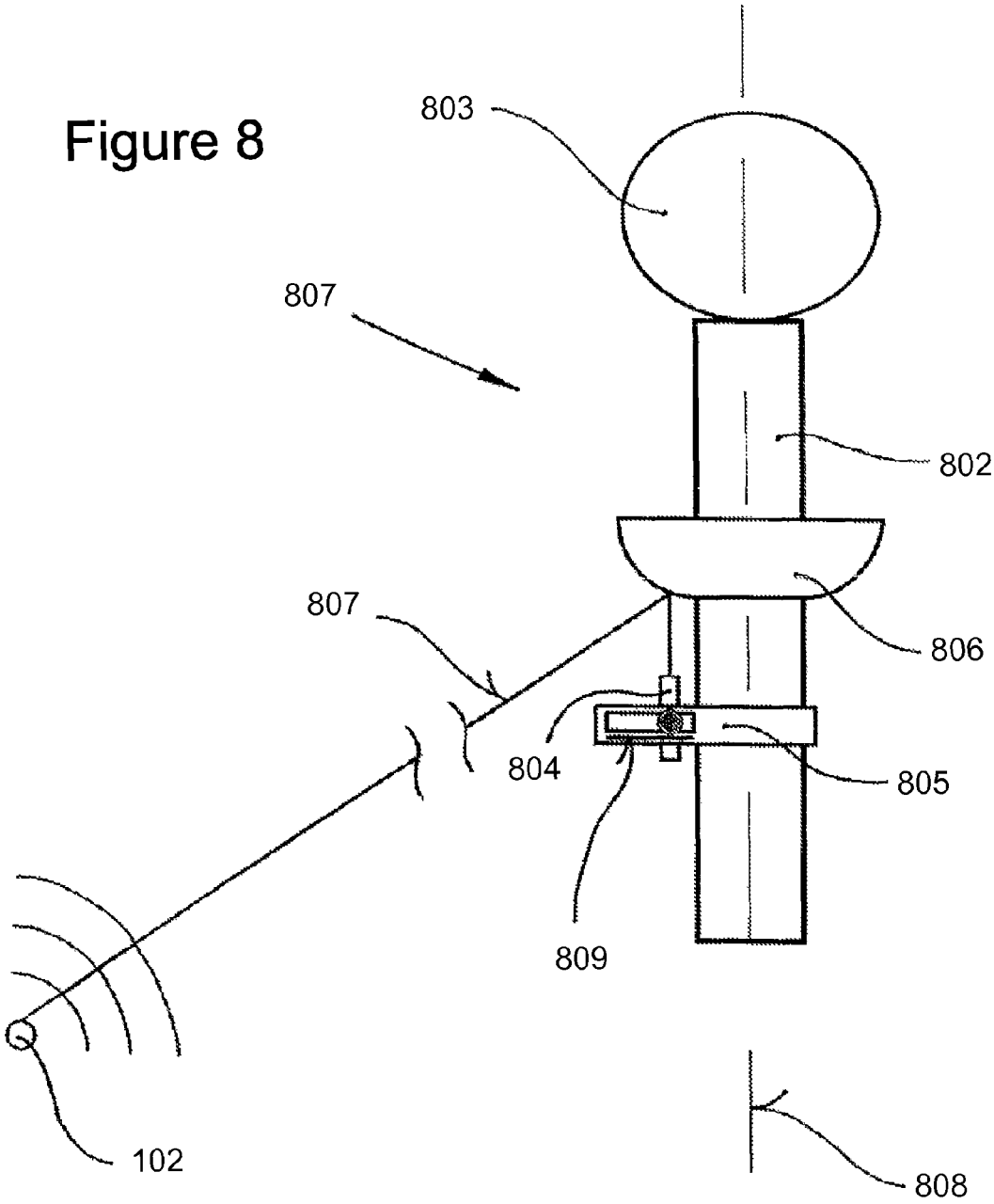

SYSTEM FOR DETERMINING THE POSITION OF SOUND SOURCES

PRIORITY CLAIM

This application is a continuation-in-part of International PCT application No. PCT/EP2006/006012 (Pub. No, WO 2006/136410 A1), filed Jun. 22, 2006 as allowed under 35 U.S.C 365(c), which claims priority to EP Application No. 05450113.5, filed Jun. 23, 2005, each of which are incorporated by reference.

BACKGROUND OF THE INVENTION

1. Technical Field

This application relates to a system for determining the position and/or direction of a sound source relative to a microphone.

2. Related Art

A microphone may measure audio or acoustic signals from a source. When recording sound events from a sound source, such as a music recording, several microphones may be used. The signals produced from each microphone may be combined into a signal that represents a recording.

It may be useful to locate the source at a pre-determined position to ensure an optimal recording. A microphone may be more sensitive to sound in one direction, which suggests that the microphone should be positioned to receive in that direction. Therefore a need exists for accurately determining the location of a sound source.

SUMMARY

A system may determine the position of a source in a fixed coordinate system. A microphone may include capsules that receive a audio signals. The audio signals are analyzed and processed to determine the position of the sound source relative to the microphone. The audio signals may be used to adjust the microphone or capsule direction based on the position of the sound source. The direction of the microphone may be adjusted during or after the audio signals are received. The receiving direction may be identified through an optical source or laser. A light beam or laser beam may be used to identify position.

Directional adjustments of the microphone may be based on a fixed coordinate system. When the microphone is placed within the fixed coordinate system it has known coordinates. Those coordinates may be used to identify relative coordinates of the sound source. Based on the position of the sound source, the direction of an optical source beam may be adjusted with reference to the fixed coordinate system.

Other systems, methods, features, and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

FIG. 5 is an alternative directivity pattern.

FIG. 6 is a microphone array.

FIG. 7 is a sound analyzer.

FIG. 8 is an exemplary microphone.

DETAILED DESCRIPTION OF THE PREFERRED EMBODIMENTS

Audio signals may determine the position of individual sound sources in a fixed coordinate system. The directivity characteristics of a microphone may be adjusted based on the received audio and the sound source distribution. The microphone may include capsules that may have a changeable directional characteristic. The capsules may receive aural signals that are converted into an audio signal representative of the audio at that capsule. The audio signals may be used to determine the locations of the sound sources. The system may include an optical source or another identifier that marks a direction of the microphone or of certain capsules. The optical source may be a laser that may pass through a lens and/or an aperture. The direction of the visible or invisible light beam relative to the fixed coordinate system may be determined and adjusted based on the identified location of the sound sources. The light may be detected by an optical or light sensitive device.

Figure 1:
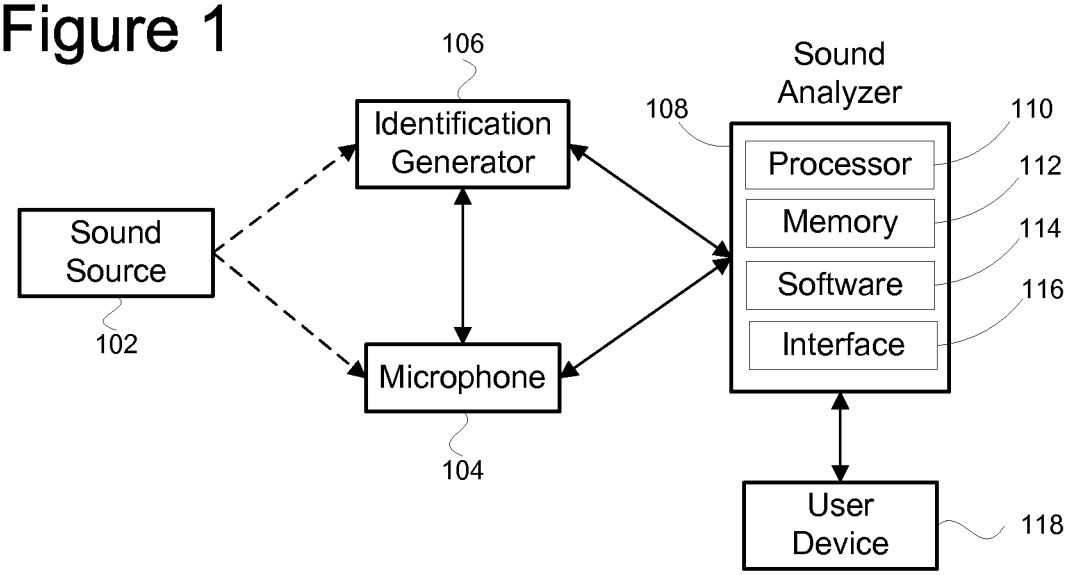
FIG. 1 is a system that determines a position of a sound source.

FIG. 1 is a system that determines a position of a sound source. A sound source 102 may be measured by a microphone 104, which may communicate with an identification generator 106. A sound analyzer 108 may receive audio signals in an analog or digital format from the microphone 104. A user device 118 may control the sound analyzer 108.

The sound source 102 may be positioned to measure sound or audio. Testing may occur during performances, such as an orchestra concert. The testing may position microphones within or near the audience to measure the sound at different locations. The orchestra or audio speakers may generate the sound. Alternatively, acoustic signals or vibrations may be detected when the signal lie in an aural range. The signals may be characterized by wave properties, such as frequency, wavelength, period, amplitude, speed, and direction. These sound signals may be detected by the microphone 104 or an electrical or optical transducer.

Figure 2:
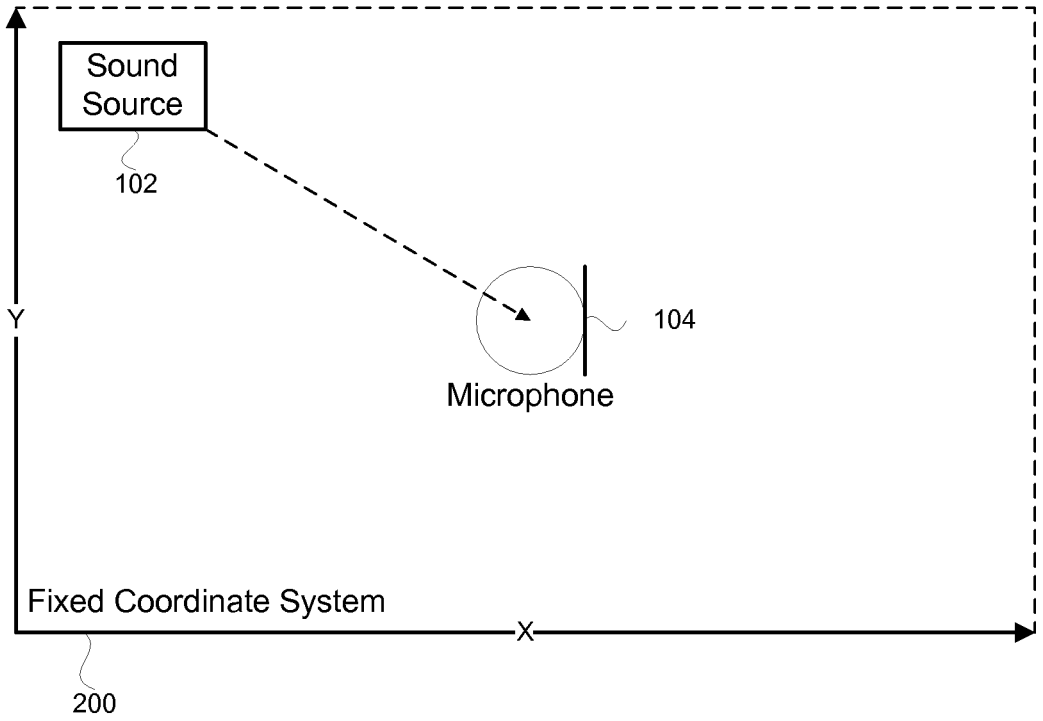
FIG. 2 is a coordinate system with a sound source.

FIG. 2 is a coordinate system 200 in which a sound source 102 may be measured. The microphone 104 may be located at an identified point in the coordinate system 200. The coordinate system 200 may be reference through an x-axis and a y-axis, allowing the microphone 104 and the sound source 102 to be identified by two coordinates. In one layout, the microphone 104 may be located near the center of a fixed coordinate system 200. The sound source 102 may be located or identified relative to the microphone 104.

The microphone 104 may be a device or instrument for measuring sound. The microphone 104 may be a transducer or sensor that converts sound/audio into an operating signal that is representative of the sound/audio at the microphone. The operating signal may be an analog or digital signal that may be sent to a second device, such as an amplifier, a recorder, a broadcast transmitter, or the sound analyzer 108.

The microphone 104 may have directional characteristics which may be changed, so that the microphone 104 may be rotated. The changes may be achieved through a mechanical link that may rotate or swivel, or the adjustment may occur automatically. Based on the directional characteristic of microphones, it may be necessary to know the relative position of the sound source with respect to the location of the microphone 104 to produce a high quality recording. The microphone 104 with a directional characteristic may be a soundfield microphone or an array microphone.

Figure 3:
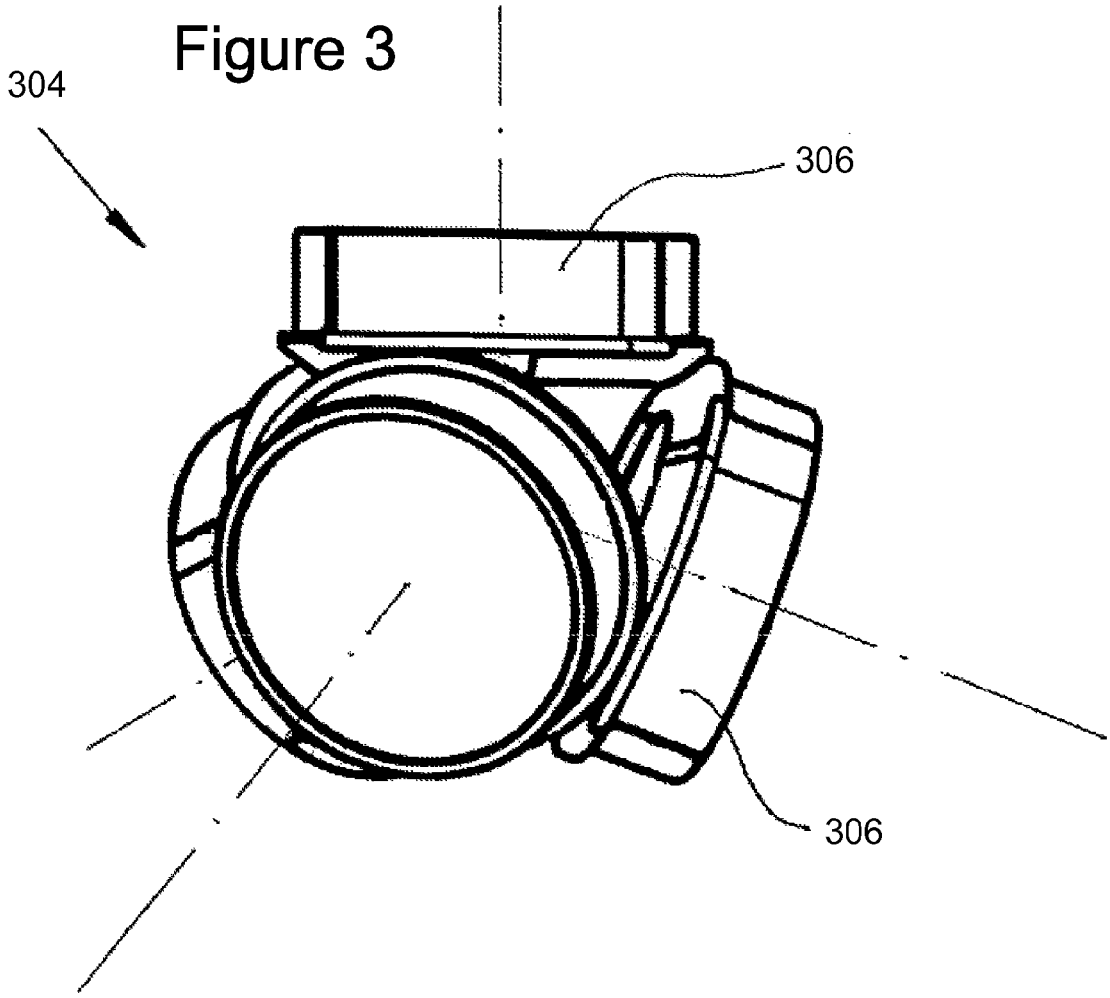
FIG. 3 is a soundfield microphone.

FIG. 3 is a soundfield microphone 304. The soundfield microphone may include a number of capsules 306. The soundfield microphone 304 may include four pressure gradient capsules 306 may be arranged on a substantially spherical surface in a neutral tetrahedral shape. In this configuration, the membranes of the capsules are nearly parallel to the sides of the tetrahedron, which comprises a four-sided polygon in the shape of a pyramid. A capsule may include a transducer, which converts acoustic sound waves into analog or digital signals. The number and the arrangement of capsules may affect a directivity pattern of the microphone.

Figure 4:
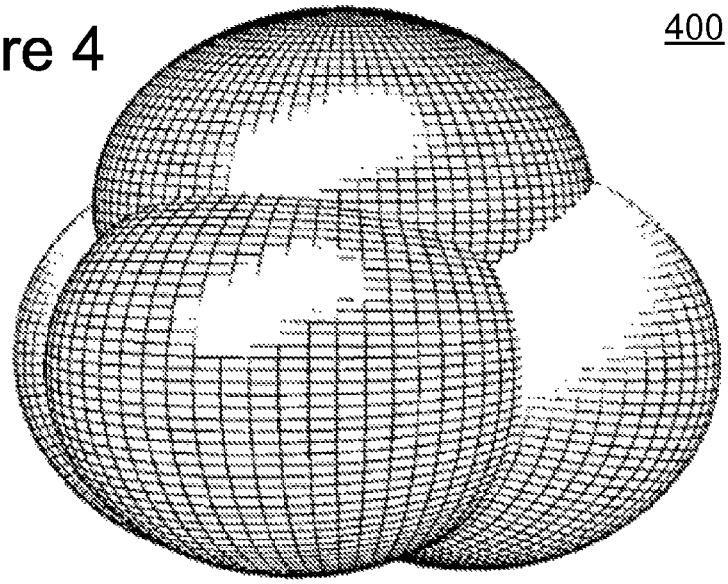
FIG. 4 is a directivity pattern.

An exemplary directivity pattern of capsule signals is shown in FIG. 4. The directivity pattern refers to the directivity pattern of real capsules, and may refer to the orientation of signals received by other devices. These signals may have complicated directivity patterns. The directivity pattern may identify which spatial regions a synthesized signal may originate or travel from. It may furnish acoustic information. The directivity pattern 400 in FIG. 4 illustrates a cardioid orientation of four capsules in a soundfield microphone. The directivity pattern of a microphone may be used to identify a location of a source and/or a needed adjustment of the position of the directivity pattern.

Alternative directivity patterns may include supercardioid, hypercardioid, omnidirectional, and figure-eight. Cardioid may have a high sensitivity near the front of a receiver or microphone and good sensitivity near its sides. The cardioid pattern has a "heart-shaped" pattern. Supercardioid and hypercardioid are similar to the cardioid pattern, except they may also be subject to sensitivity behind the microphone. Omnidirectional patterns may receive sound almost equally from all directions relative to a receiver or microphone. A figure-eight may be almost equally sensitive to sound in the front and the back ends of the microphone, but may not be sensitive to sound received near the sides of the microphone.

A directivity pattern may be obtained or modeled by combining capsule signals. An omnidirectional, a figure-eight, and a cardioid may be combined. In this combination, the amplitude of both signals may be equally large. By weighting the omnidirectional and figure-eight signal pattern, the resulting directivity pattern may be adjusted between an omnidirectional and a figure-eight pattern, for example, from a cardioid to a hypercardioid pattern. The frequency response of the omnidirectional and figure-eight signal may be adjusted separately before the signals are combined. An exemplary microphone and its modeling are described in commonly owned U.S. application Ser. No. 11/472,801, U.S. Pub. No. 2007/0009115, filed Jun. 21, 2006, entitled "MODELING OF A MICROPHONE," which is incorporated by reference.

In the sound field microphone 304, each of the individual capsules may yield a signal A, B, C, and D. Each one of the pressure gradient receivers may present a directional characteristic that deviates from an omni directional characteristic, which may be approximated in the form $(1-k)+k \times \cos(\theta)$, in which $\theta$ denotes the azimuth under which the capsule is exposed to sound and the ratio factor k may designates an amount by which the signal deviates from an omni directional signal. For example, in a sphere k=0, but in a figure eight k=1. The cylindrical axis of the directional characteristic of each individual capsule may be substantially perpendicular to the membrane or to the corresponding face of the tetrahedron. The individual capsules may have directional characteristics in different directions.

According to one calculation, the four signals may be converted to the B format (W, X, Y, Z). The calculation of the four signals, A, B, C, and D may be:

$$W=\tfrac{1}{2}(A+B+C+D);$$

$$X=\tfrac{1}{2}(A+B-C-D);$$

$$Y=\tfrac{1}{2}(A+B+C-D);\text{ and}$$

$$Z=\tfrac{1}{2}(A+B-C+D).$$

The signals produced may correspond to an omni directional characteristic or sphere (W) and a figure-of-eight pattern (X, Y, X), which may be substantially orthogonal with respect to each other and extend each along the x, y, and z directions. FIG. 5 is a diagram of a directivity pattern 500 illustrating the B format. The directivity pattern 500 may illustrate the directivity the lobes/directions of the B format. The directivity pattern 500 includes three figure-eights arranged along the three spatial directions x, y, and z. The main directions of the figure-eight may be substantially normal with respect to the sides of a cube enclosing the tetrahedron.

Some systems may combine B format signals to modify desired characteristics of the microphone. By combining the signals that present an omni-directional characteristic with a signal that presents a figure-eight pattern signal characteristic, a cardioid-shaped pattern may be obtained. Signal weighting may be used to obtain a desired directional characteristic with a desired preferential orientation for the overall signal. A combination of the individual capsule signals received through the B format may be known as "synthesizing an overall microphone." A desired directional characteristic may be adjusted or set after the sound event has occurred, by appropriate mixing of the individual B format signals.

The desired directional characteristic of a microphone may depend on the sound source or sound sources to be recorded. A microphone orientation may depend on the position of the sound source relative to the microphone. For example, a solo instrument within an orchestra may be an identified sound source. In this instance, the microphone may be oriented to maximize the sound from that solo instrument. The relative position of the sound source with respect to a principal direction of the microphone may be used to position or orientate the microphone. The principal direction of the microphone may be manually or automatically positioned to a desired direction. In a soundfield microphone, there may be four equivalent principal directions (each substantially perpendicular to the membrane). A preferential direction may exist at the time of the synthesizing of the overall signal from the individual capsule signals. This preferential direction may be rotated using signal processing techniques.

A mechanical principal direction may be utilized in the determination of the position of sound sources. The mechanical principal direction may be chosen in many ways. In some processes, the relative orientation of the arrangement of the individual capsules with respect to the principal direction should be identified. Establishing the principal direction may establish how the individual microphone capsules are oriented in space. With soundfield microphones, such a principal direction may be implemented by a marking or other identifier, such as an optical or light source in the form of a laser or light emitting diode (LED). The principal direction may establish a coordinate system with a microphone located with the coordinate system. In one system, the microphone may be located near the center of the coordinate system.

The audio processing may identify individual sound sources. The principal direction of the microphone and the orientation of the capsule arrangement may be used with the processed audio to influence the behavior of the microphone. For example, the directional characteristic and/or orientation in space may be adjusted relative to the mechanical principal direction.

The microphone 104 is not limited to soundfield microphones. Microphones with two or more capsules, whose signals may be processed and combined by signal processing techniques, may also be used. The microphones may have a changeable directional characteristic, which may be set and optimized after the recording. The position of sound sources may be identified using the capsules by processing and analyzing the signals, which may comprise different data that identifies directional function. An array microphone is another example of the microphone 104. FIG. 6 is an array microphone 604. An array microphone may be arranged along one dimension such as along a line. The array microphone 604 may include several capsules 606. Alternatively, an array microphone may be arranged about a two or three dimensional area or distributed in space. The multi-dimensional array microphone may obtain a precise image of the sound source(s) by interconnecting coupled sound sensors in a network.

In FIG. 1, the microphone 104 may communicate with the identification generator 106. The microphone 104 and identification generator 106 may communicate with the sound analyzer 108. The identification generator 106 may be used to identify a principal direction of the microphone 104 and/or to identify the location of the sound source 102. In one system, the identification generator 106 may be a light source or light beam, such as a laser. The light beam or laser may be directed towards the principal direction of the microphone 104 and/or the location of the sound source 102.

The light beam may vary based on the system. The light may have a relatively constant-diameter beam over the range of sensitivity of the directional microphone 104. Due to spherical spreading, the diameter of light beam may increase with range. The use of lens configurations, as discussed below, may make a beam more easily visible near the maximum usable range of the microphone 104. The light source may direct a light beam in a direction aligned with an axis of sensitivity of the microphone 104. The light beam may identify an axis of increased sensitivity of the microphone.

The light beam may be directed toward the sound source (or the position to be assumed by the sound source during the sound event). The angle with respect to the predefined mechanical principal direction may be determined. For example, before recording the music of an orchestra, the light beam may be directed toward the chair of each individual orchestra member, and the angle (azimuth and elevation) with respect to the principal direction may be determined. Such a cartographically described orchestra landscape may used during the mixing to emphasize certain spatial areas and to filter out interfering noises or mistakes (improperly executed notes) from a certain direction. These processes may occur as a function of time, for example, as the solo parts move within an orchestra concert.

The sound analyzer 108 may communicate with the microphone 104 and/or the identification generator 106. In some systems, the microphone 104, the identification generator 106, the sound analyzer 108, and/or the user device 110 may comprise a unitary component or may be multiple components. For example, the microphone 104 may include the identification generator 106 and the sound analyzer 108. The sound analyzer 108 may be a computing device that receives signals representative of acoustics and analyzes those signals. The acoustic or audio may originate from one or more sound sources, such as the sound source 102.

The sound analyzer 108 may process audio signals based on information regarding the orientation and direction of the microphone. The spatial arrangement of the capsules of the microphone with respect to the position of the sound source may be considered during signal processing. Further information may also be used, such as the location of at least one sound source (soloists and/or individual orchestra members), the direction of a spatial barycenter of several sound sources (e.g. of the violinists or wind musicians of an orchestra), and the direction from which the best recording may be expected. For example, the resulting microphone signal may be rotated based on the location information. In addition, interfering signals may be expected, such as the audience of a concert hall. Any of this information may be used to combine and weight the individual audio signals and may be included in the process of signal processing, in order adjust the directivity characteristics of the resulting microphone and its capsules to achieve better results and improve sound quality.

The sound analyzer 108 may include a processor 110, memory 112, software 114 and an interface 116. The interface 116 may include a user interface that allows a user to interact with any of the components of the sound analyzer 108. For example, a user of the user device 118 may modify the data or parameters that are used by the sound analyzer 108 to analyze the sound source 102.

The processor 110 in the sound analyzer 108 may include a central processing unit (CPU), a graphics processing unit (GPU), a digital signal processor (DSP) or other type of processing device. The processor 110 may be a component in any one of a variety of systems. For example, the processor 110 may be part of a standard personal computer or a workstation. The processor 110 may be one or more general processors, digital signal processors, application specific integrated circuits, field programmable gate arrays, servers, networks, digital circuits, analog circuits, combinations thereof, or other now known or later developed devices for analyzing and processing data. The processor 110 may operate in conjunction with a software program, such as code generated manually (i.e., programmed).

The processor 110 may communicate with a local memory 112, or a remote memory 112. The interface 116 and/or the software 114 may be stored in the memory 112. The memory 112 may include computer readable storage media such as various types of volatile and non-volatile storage media, including to random access memory, read-only memory, programmable read-only memory, electrically programmable read-only memory, electrically erasable read-only memory, flash memory, magnetic tape or disk, optical media and the like. In one embodiment, the memory 112 includes a random access memory for the processor 110. In alternative embodiments, the memory 112 is separate from the processor 110, such as a cache memory of a processor, the system memory, or other memory. The memory 112 may be an external storage device or database for storing recorded image data. Examples include a hard drive, compact disc ("CD"), digital video disc ("DVD"), memory card, memory stick, floppy disc, universal serial bus ("USB") memory device, or any other device operative to store image data. The memory 112 is operable to store instructions executable by the processor 110.

The functions, acts or tasks illustrated in the figures or described herein may be processed by the processor executing the instructions stored in the memory 112. The functions, acts or tasks are independent of the particular type of instruction set, storage media, processor or processing strategy and may be performed by software, hardware, integrated circuits, firm-ware, micro-code and the like, operating alone or in combination. Processing strategies may include multiprocessing, multitasking, or parallel processing. The processor 110 may execute the software 114 that includes instructions that analyze signals.

The interface 116 may be a user input device or a display. The interface 116 may include a keyboard, keypad or a cursor control device, such as a mouse, or a joystick, touch screen display, remote control or any other device operative to interact with the sound analyzer 108. The interface 116 may include a display that communicates with the processor 110 and configured to display an output from the processor 110. The display may be a liquid crystal display (LCD), an organic light emitting diode (OLED), a flat panel display, a solid state display, a cathode ray tube (CRT), a projector, a printer or other now known or later developed display device for outputting determined information. The display may act as an interface for the user to see the functioning of the processor 110, or as an interface with the software 114 for providing input parameters. In particular, the interface 116 may allow a user to interact with the sound analyzer 108 to determine a position of the sound source 102 based on the data from the microphone 104.

FIG. 7 is an exemplary sound analyzer 108. The sound analyzer 108 may include a sound recorder 702, a location calculator 704, and/or a direction modifier 706. The sound recorder 702 may be in communication with the microphone 104. Any of the sound recorder 702, the location calculator 704, and/or the direction modifier 706 may be in communication with the processor 110 through the interface 116 for analyzing and processing audio signals received from the microphone.

The sound recorder 702 may receive the sounds or audio signals that are obtained by the microphone 104. The audio signals may be analog signals that are converted to digital signals by an analog-to-digital converter. The sound recorder 702 may store the received audio signals for future processing or may pass the signals to the processor 110 for real-time processing. The stored audio signals may be analyzed after an event (such as a concert) or may be used during the event to adjust the microphone 104 or to identify a particular sound source, such as the sound source 102.

The location calculator 704 may analyze the audio signals that are received or stored by the sound recorder 702. The location calculator 704 may include the processor 110. The location calculator 704 may determine a location or position of the sound source 102 based on the audio signals received by the microphone 102. The microphone 102 may have capsules, each of which provides an audio signal that are analyzed by the location calculator 704. Each audio signal may be analyzed to determine a signal strength or a strength of the audio at that capsule. That information, along with the directivity components of the microphone 102 and its capsules may be used by the location calculator 704 to identify the location or position of sound sources, such as the sound source 102. The B format signals from a soundfield microphone may be used for determining directional characteristics of a soundfield microphone. The location of the sound source 102 and/or the microphone 102 may be identified based on a fixed coordinate system as in FIG. 2.

The direction modifier 706 may be in communication with the identification generator 106 to adjust the identifier. When the identifier is a light beam, the direction modifier 706 may adjust the direction that the light beam is marking. The direction modifier 706 may point its light beam in the direction of the principal direction of the microphone 104. The light beam may be adjusted to point towards the sound source 102 as determined by the location calculator 704.

The user device 118 may be a computing device for a user to interact with the microphone 104, the identification generator 106, or the sound analyzer 108. A user device may include a personal computer, personal digital assistant ("PDA"), wireless phone, or other electronic device. The user device 118 may include a keyboard, keypad or a cursor control device, such as a mouse, or a joystick, touch screen display, remote control or any other device that allow a user adjust the position of the microphone 104, or the direction of the identification generator 106. In one system, the user device 118 may be a remote control that can remotely adjust the microphone 104 and the identification generator 106.

FIG. 8 is an exemplary microphone 801. The microphone 801 may be a soundfield microphone, such as the soundfield microphone 304 illustrated in FIG. 3. The microphone 801 includes an identification generator 106 integrated with the laser 804. The laser 804 is located on a shaft 802 of the microphone 801. The shaft 802 or pole of the microphone holds the upper spherical area 803 of the microphone 801. The capsules of the microphone 801, such as in the soundfield microphone 304 or the array microphone 604, may be arranged in the upper spherical area 803 behind a microphone grid.

The laser 804 may be shifted radially along a guide rail 805 with respect to the shaft 802. The rail 805 may be arranged so that it can be rotated about the shaft 802. A rotation symmetrical curved mirror line 806 deflects a laser beam 807 as a function of the radial separation of the laser 804 from the middle of the shaft 802. The laser beam 807, which is directed toward the sound source 102, may pass through an axis 808 of the microphone shaft 802. The offset between the mirror 806 and the capsule arrangement in the spherical area 803 may have little or no effect on the evaluation because it may be negligibly small in comparison to the separation of the overall microphone 801 from the sound source 102 to be recorded.

A measuring stick 809, which may arranged on the guide rail 805, may show an instantaneous elevation. Likewise, a measuring stick on the circumference of the shat 802 (not shown) may show an instantaneous azimuth. Using these two angles, the direction of the sound source 102 may be determined. In one system, the axis 808 of the microphone shaft 802 may be the above-defined principal direction of the microphone 801. However, any direction may be used as the principal direction and the relative positions in the fixed coordinate system may be determined based on the principal direction. The position of the sound source 102 or sound sources may be calculated with the corresponding angles with respect to the principal direction. In one system, the mirror 806 may be replaced with another optical deflection device, such as lenses, prisms or similar parts.

Figure 9:
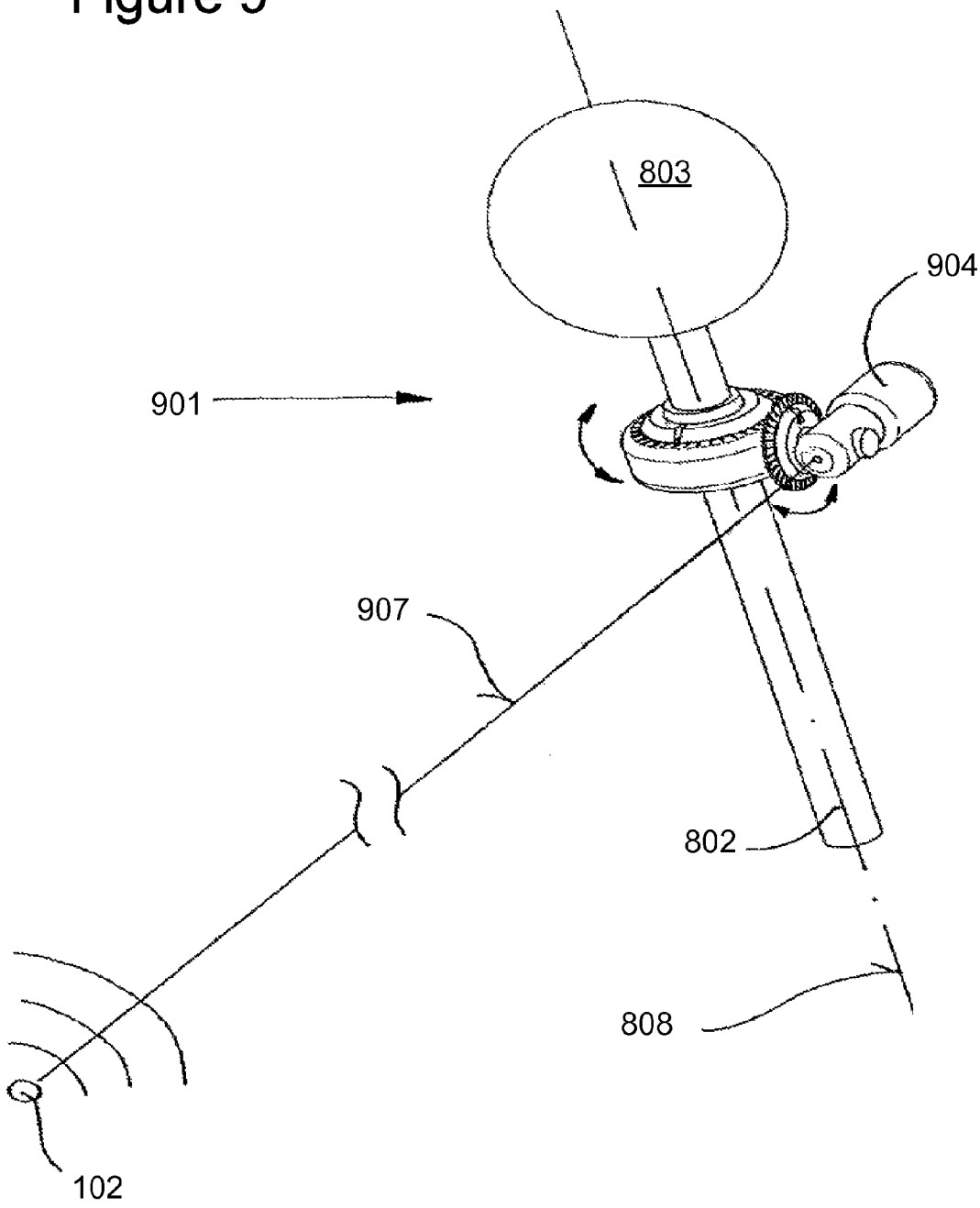
FIG. 9 is an alternative exemplary microphone.

FIG. 9 is another exemplary microphone 901. The laser 904, which may be the identification generator 106, may output the laser beam 907 directed towards the sound source 102. Rather than using a deflection mirror, the light source 904 may be attached to the microphone 901 so that it may be rotated about two spatial directions. In this system, with the exception of small shadow areas, which may be caused by the microphone, the entire area may be sensed. The determination of the angle or the position of the sound source 102 may also be carried out using automatic transducers or sensors, and the data may be transmitted to a computer by radio transmission with a radio transmitter connected to the sensor (s). Rather than being manually controlled, the direction of the laser beam 907 may be controlled by a motor, for example, a step motor. The motor may be remote controlled, for example, using a relative pointing device, absolute pointing device, or other user controlled device 118. This system may be used in concert halls where access to the microphones is difficult. The microphones may be adjusted remotely using the user device 118. The position of the sound source 102, which may identified by a light source such as the laser 904, may then be determined from the position of the motor.

The sound analyzer 108 and/or identification generator 106 may be located directly on the microphone, or may be coupled to a microphone stand, a microphone tripod, or a microphone suspension, on or in the area of the microphone holder. In one system, the distance to the capsule is minimized to reduce errors that may be caused by the traveling of the audio signals. The light source or identification generator 106 may be located in the proximity of the location of the microphone. In this system, one may consider where the device is used, such as in the vicinity of the intended location of the microphone, for the determination of the position of sound sources. Also, the microphone may be attached to the location after the measurement of the sound sources. If the information concerning the position of the sound sources becomes available at the time of the subsequent mixing or analysis, the determination of the position may also be possible after the recording. The location of the microphone during recording with respect to the fixed coordinate system may be used along with the arrangement and orientation of the individual capsules for the analysis. Once defined, the fixed coordinate system may be determined by the spatial arrangement of individual capsules.

Figure 10:
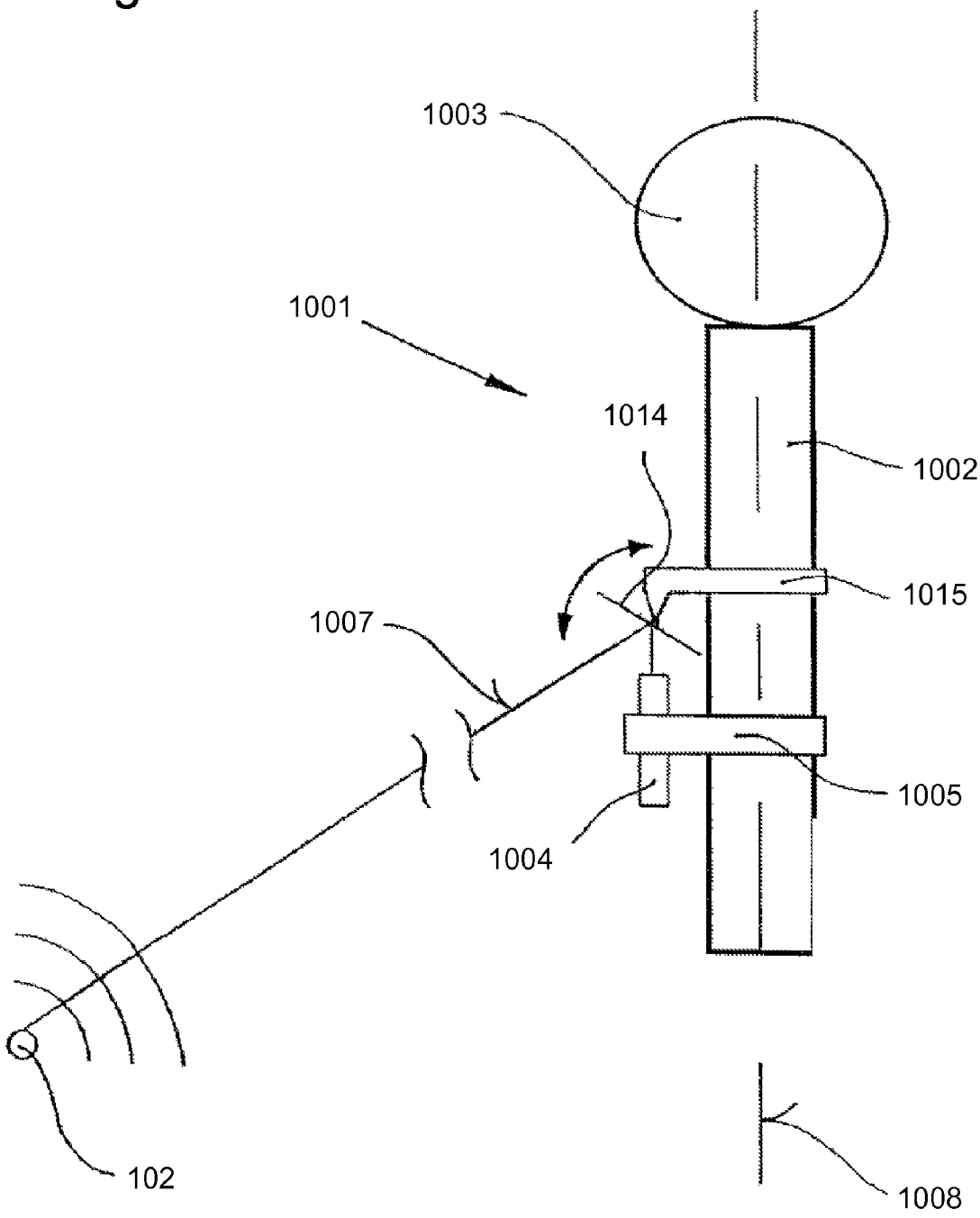
FIG. 10 is a second alternative exemplary microphone.

FIG. 10 is another exemplary microphone 1001. The light source 1004 may be fixed to the microphone shaft 1002 with the guide rail 1005. The light source 1004 may not be moved with respect to the microphone 1001 and the fixed coordinate system when determining the position of the sound source 102. Rather than a movable light source 1004, a movable deflector 1014 or deflection means may be provided to direct the light beam 1007 emitted by the light source 1004 in a desired direction. The deflector 1014 may be transversally movable along the microphone axis 1008. The deflector 1014 may include rotary mirrors and/or flexible glass fibers serving as a duct for the light beam 1007. The deflector 104 as shown in FIG. 10 has a rotary hinged on a support 1015. The deflector 1014 may determine the direction of the light beam 1007 and be located in the vicinity of the microphone 1001, although the light source 1004 may be located away from the microphone 1001. The deflector 1014 may be manually adjustable by hand and/or may be adjusted automatically, such as with a step motor and a remote control. The adjustment may be performed in near real-time as audio signals are received.

Figure 11:
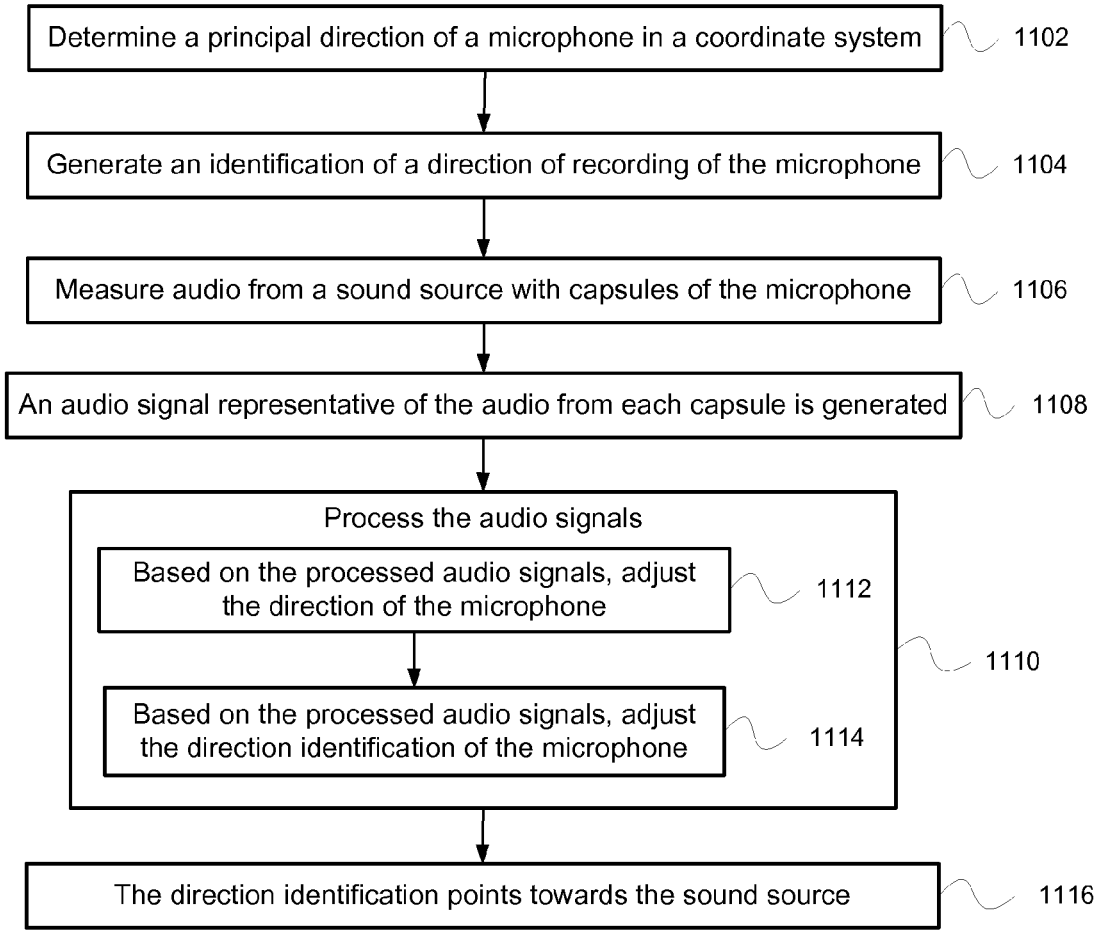
FIG. 11 is a process for the determination of a sound source.

FIG. 11 is a flow chart illustrating the determination of a sound source. In block 1102, the microphone is placed in a fixed coordinate system and a principal direction of the microphone may be determined. Before the beginning of a recording the principal direction is defined and a coordinate system is fixed. The coordinate system may make the orientation of a capsule arrangement of the microphone apparent and be used for identifying a relative position of the individual sound sources. The principal direction or the coordinate system may be chosen in any desired manner, as long as the sound technician is able to infer the capsule arrangement based on that arrangement.

In block 1104, an identification of the principal direction of the microphone is established. In one system, a light source or laser may generate a light beam or laser beam that identifies the principal direction of the microphone. In block 1106, audio is measured from the sound source with the capsules of a microphone. There may be multiple microphones, and each microphone may include one or more adjustable capsules. The direction of the capsules may be determined by the principal direction of the microphone. Each capsule may measure audio and generate an audio signal based on that audio as in block 1108. The microphone may generate multiple audio signals from its capsules.

The audio signals from the microphone may be processed in block 1110. The processing of the audio signals may include recording the signals and analyzing them with the sound analyzer to identify a location of the sound source. In block 1112, the direction of the microphone may be adjusted based on the processed audio signals. The analysis of the audio signals may reveal that the principal direction of the microphone is not directed towards the sound source. The microphone may be adjusted manually or automatically with a motor and remote control. The adjustment may occur after recording the audio signals or may occur in near real-time while the audio signals are being recorded. In addition, the direction identification of the microphone may be adjusted in block 1114. In some systems, a light beam that identifies the principal direction of the microphone may be adjusted based on the audio signals that were recorded by the microphone. The adjustment of the direction identification may result in the identifier pointing towards the sound source in block 1116.

In one system, the recording of an orchestra may be analyzed. For the recording, a microphone may be placed in the proximity of the orchestra. After the principal direction has been established, a light beam may be successively directed on the different (still empty) chairs of the orchestra members and the angle with respect to the principal direction may be measured. One may take into account the fact that, after the measurement of the sound sources, the position and orientation of the microphone may no longer be changed. During the mixing of the recording, the directional effect of the microphone may be directed towards each orchestra member, using the angle that was measured previously.

The system and process described may be encoded in a signal bearing medium, a computer readable medium such as a memory, programmed within a device such as one or more integrated circuits, one or more processors or processed by a controller or a computer. If the methods are performed by software, the software may reside in a memory resident to or interfaced to a storage device, synchronizer, a communication interface, or non-volatile or volatile memory in communication with a transmitter. A circuit or electronic device designed to send data to another location. The memory may include an ordered listing of executable instructions for implementing logical functions. A logical function or any system element described may be implemented through optic circuitry, digital circuitry, through source code, through analog circuitry, through an analog source such as an analog electrical, audio, or video signal or a combination. The software may be embodied in any computer-readable or signal-bearing medium, for use by, or in connection with an instruction executable system, apparatus, or device. Such a system may include a computer-based system, a processor-containing system, or another system that may selectively fetch instructions from an instruction executable system, apparatus, or device that may also execute instructions.

A "computer-readable medium," "machine readable medium," "propagated-signal" medium, and/or "signal-bearing medium" may comprise any device that includes, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium. A non-exhaustive list of examples of a machine-readable medium would include: an electrical connection "electronic" having one or more wires, a portable magnetic or optical disk, a volatile memory such as a Random Access Memory "RAM", a Read-Only Memory "ROM", an Erasable Programmable Read-Only Memory (EPROM or Flash memory), or an optical fiber. A machine-readable medium may also include a tangible medium upon which software is printed, as the software may be electronically stored as an image or in another format (e.g., through an optical scan), then compiled, and/or interpreted or otherwise processed. The processed medium may then be stored in a computer and/or machine memory.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A method for receiving audio at a microphone comprising:

determining a fixed coordinate system identifying a position of the microphone relative to the fixed coordinate system, where the microphone includes a plurality capsules;

receiving audio signals representative of at least one sound source, where each of the capsules generates an audio signal;

analyzing the audio signals based on the known positions of the microphone and capsules in the fixed coordinate system;

adjusting a direction of at least one of the capsules based on the analysis of the analyzed audio signals received at that at least one capsule;

providing an identification of a principal direction of the microphone, where the principal direction of the microphone is known relative to the fixed coordinate system; and adjusting the identification of the principal direction of the microphone based on the analysis of the analyzed audio signals, where the identification comprises a light source that illuminates a direction of the microphone.

2. The method of claim 1 where the principal direction of the microphone is adjusted towards one of the at least one sound sources.

3. The method of claim 1 where the microphone comprises a soundfield microphone or an array microphone.

4. A system for determining a position of a sound source comprising:

a microphone including a plurality of capsules, where each capsule measures an audio value where the microphone includes a deflector and a measuring stick;

a sound analyzer in communication with the microphone that receives an audio signal representative of the audio value for the capsules; and an identification generator in communication with the sound analyzer that comprises a light source;

where the sound analyzer identifies a location of the sound source with respect to a fixed coordinate system based on the audio signals and the identification generator marks the location of the sound source with respect to the fixed coordinate system and where the measuring stick adjusts an output of the light source and the deflector reflects and directs the light source.

5. The system of claim 4 where the microphone is located near a center of the fixed coordinate system.

6. The system of claim 4 where the identified location is identified based on coordinates in the fixed coordinate system.

7. The system of claim 4 where the identification generator marks the location by pointing the light source at the location.

8. The system of claim 4 where the light source comprises a laser.

9. The system of claim 4 where the deflector comprises a mirror, a lens, or a prism, further where one of the deflector or the light source is rotatable to adjust a direction of a light beam from the light source.

10. A method of determining a position of a sound source comprising:

measuring audio from the sound source with microphone capsules that generate audio signals representative of the audio from the sound source, where each audio signal is representative of the audio from a respective one of the microphone capsules;

generating an identification of a direction of the microphone capsules;

processing the audio signals to determine the position of the sound source; and modifying the direction of the microphone capsules based on the determined position of the sound source, where the identification of the direction of the microphone capsules is in the modified direction of the microphone capsules and where the identification of a direction of the microphone capsules comprises a light beam that is shined in the direction of the microphone capsules.

11. The method of claim 10 where the direction of the microphone capsules is modified in near real-time as the audio signals are processed.

12. The method of claim 10 where the position of the sound source is identified with respect to a fixed coordinate system.

13. The method of claim 12 where a microphone comprises the microphone capsules and the microphone is located near a center of the fixed coordinate system and the position is determined by coordinates from the fixed coordinate system.

* * * * *

UNITED STATES PATENT AND TRADEMARK OFFICE

CERTIFICATE OF CORRECTION

PATENT NO. : 8,170,260 B2
APPLICATION NO. : 11/961354
DATED : May 1, 2012
INVENTOR(S) : Reining et al.

It is certified that error appears in the above-identified patent and that said Letters Patent is hereby corrected as shown below:

In FIG. 8, the microphone currently labeled with reference numeral 807 should be labeled with reference numeral 801.

At column 3, line 16, "...the capsules are..." should be changed to -- the capsules 306 are --

At column 3, line 18, "A capsule may..." should be changed to -- A capsule 306 may --

At column 3, line 20, "...of capsules may" should be changed to -- of capsules 306 may --

At column 3, line 21, "...of the microphone." should be changed to -- of the microphone 304. --

At column 6, line 1, "...the user device 110..." should be changed to -- the user device 118 --

At column 7, line 66, "...the microphone 102..." should be changed to -- the microphone 104 --

At column 8, line 46, "...the shat 802..." should be changed to -- the shaft 802 --

At column 9, line 49, "The deflector 104..." should be changed to -- The deflector 1014 --

At column 11, line 34, claim 1, "determining a fixed coordinate system" should be changed to -- determining a fixed coordinate system; --

Signed and Sealed this
Twenty-ninth Day of January, 2013

David J. Kappos

David J. Kappos
*Director of the United States Patent and Trademark Office*